US008567850B2

(12) United States Patent
Honda et al.

(10) Patent No.: US 8,567,850 B2
(45) Date of Patent: Oct. 29, 2013

(54) UPPER FRAME FOR CONSTRUCTION MACHINE

(75) Inventors: Yosuke Honda, Hiroshima (JP); Koichi Nishimura, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 0 days.

(21) Appl. No.: 13/288,336

(22) Filed: Nov. 3, 2011

(65) Prior Publication Data

US 2012/0112495 A1 May 10, 2012

(30) Foreign Application Priority Data

Nov. 10, 2010 (JP) ..... 2010-251854

(51) Int. Cl.
*B62D 33/10* (2006.01)

(52) U.S. Cl.
USPC ..... 296/190.07; 296/35.1; 180/89.13; 267/140

(58) Field of Classification Search
USPC ..... 296/190.01, 190.07, 190.04, 35.1, 35.2; 180/89.13, 89.1; 267/130, 140, 152, 267/153, 293
See application file for complete search history.

(56) References Cited

FOREIGN PATENT DOCUMENTS

| | | |
|---|---|---|
| JP | 2000-104284 | 4/2000 |
| JP | 2001-342646 | 12/2001 |

*Primary Examiner* — Glenn Dayoan
*Assistant Examiner* — Melissa A Black
(74) *Attorney, Agent, or Firm* — Oblon, Spivak, McClelland, Maier & Neustadt, L.L.P.

(57) ABSTRACT

In a side deck of a construction machine, includes a cross allowing member which has a shape avoiding a reinforcement member so as to allow the reinforcement member to extend across a mount holding member longitudinally of the side deck. A front end of the reinforcement member is directly joined to the front beam while the reinforcement member extends longitudinally across the cross allowing member.

8 Claims, 7 Drawing Sheets

UPPER FRAME FOR CONSTRUCTION MACHINE

BACKGROUND OF THE INVENTION

1. Field of the Invention

The present invention relates to an upper frame for a construction machine such as a hydraulic shovel, and more particularly to an upper frame provided with a side deck on which a cabin is loaded.

2. Description of the Background Art

The background art of the invention will be explained with reference to a hydraulic shovel shown in FIG. 8 as an example.

The hydraulic shovel comprises a crawler-type lower propelling body 1 and an upper slewing body 2 which is loaded on the lower propelling body 1 slewably about an axis perpendicular to the ground. The upper slewing body 2 includes an upper frame 3 as a base thereof, on which various devices including a cabin 4 are loaded. A working attachment 5 is mounted on a front part of the upper frame 3 and on the right side of the cabin 4, and a counterweight 6 is mounted on a rear end of the upper frame 3.

In the specification, the cabin 4 is located on the left-front part, and "left and right directions" (a lateral direction), and "front and rear directions" (a longitudinal direction) are defined with respect to the position of the cabin 4.

FIGS. 9 through 13 show a structure of the upper frame 3.

The upper frame 3 is constituted of a center section A positioned at a center of the upper frame 3 in the width direction of the hydraulic shovel, and left and right side decks B, C formed on left and right ends of the center section A so as to protrude outwardly from the center section A. The working attachment 5 and the counterweight 6 are attached to a front part and a rear end of the center section A, respectively. The cabin 4 is loaded on the left side deck B, and various devices such as an unillustrated tank are loaded on the right side deck C.

The center section A has a bottom plate 7 to which an unillustrated swing bearing is mounted, and a pair of left and right vertical plates 8, 9 formed on the bottom plate 7. The vertical plates 8, 9 vertically rise from left and right ends of the center section A while extending longitudinally.

The left side deck B includes a front beam 10, a rear beam 11, and left and right vertical beams 12, 13, which beams 10, 11, 12 and 13 constitute a frame-shaped body. Furthermore, a connecting member is optionally mounted to an intermediate portion of the body, while only one transverse bar 14 is shown as the connecting member in FIGS. 9 through 12.

The left side deck B has a pair of left and right mount holding members 16, 17 as shown in FIG. 9 and FIG. 10. The mount holding members 16, 17 are disposed at left and right sides of a front end of the left side deck B to hold a front part cabin mount 15 as shown in FIG. 13, respectively. The mount holding members 16, 17 are laterally symmetrical in shape, having the same basic constructions. In view of this, the details of the right mount holding member 17 are exemplarily shown in FIGS. 11 through 13.

Each of the mount holding members 16, 17 integrally includes a horizontal upper plate portion 18 and a rear plate portion 19 extending perpendicularly downward from a rear end of the upper plate portion 18. The right mount holding member 17 is fixed to an inner lateral surface of a corner portion formed by the front beam 10 and the right vertical beam 13 by welding, and the left mount holding member 16 is fixed to an inner lateral surface of a corner portion formed by the front beam 10 and the left vertical beam 12 by welding, respectively. The upper plate portion 18 of each of the mount holding members 16, 17 has a mount insertion hole 20 into which the front part cabin mount 15 is inserted and holds the front part cabin mount 15 inserted into the mount insertion hole 20.

The left and right side portions of the rear beam 11 are provided with similar mount attachment holes 21, 21, respectively, as shown in FIGS. 9 and 10, into which not shown rear cabin mount are inserted respectively to be attached to the rear beam 11.

The above-described structure is disclosed in Japanese Unexamined Patent Publication No. 2000-104284. The publication discloses a technology of attaching a reinforcement member 22 as shown in FIGS. 9 through 13 to at least one of the inner lateral surfaces of the left and right vertical beams 12, 13 to reinforce the left side deck B. FIGS. 9 through 13 show an example in which the reinforcement member 22 is attached to the right vertical beam 13.

The reinforcement member 22 disclosed in the above publication has a cross section integrally including an upper plate portion and a lower plate portion aligned in a vertical direction and a vertical plate portion vertically extending so as to interconnect respective outer ends of the upper plate portion and the lower plate portion, and the upper plate portion and the lower plate portion are joined, for example, by welding to the inner surface of the right vertical beam 13 over the entire length of each of the upper plate portion and the lower plate portion. Besides, the reinforcement member 22 has a rear end to be joined to a front surface of the rear beam 11 and a front end to be joined to the rear plate portion 19 of the right mount holding member 17. The rear end of the reinforcement member 22 is joined to the front surface of the vertical joint plate in the case where a rear portion of the right vertical beam 13 is cut and another beam member is joined to the reinforcement member 22 via a vertical joint plate for convenience of e.g. pipe connection; alternatively, the rear end of the reinforcement member 22 is joined to the front surface of the connecting beam in the case where a connecting beam is bridged between respective longitudinally intermediate portions of the left and right vertical beams 12, 13.

The structure as described above has a problem of a low reinforcement effect at the front end of the reinforcement member 22. In this structure, the front end of the reinforcement member 22 is indirectly joined to the front beam 10 via the mount holding member 17, which forces the mount holding member 17 to serve as a part of a reinforcement member, in other words, forces the mount holding member 17 to constitute an extension of the reinforcement member 22; however, the mount holding member 17 is just designed to support the cabin 4 and not designed to provide such a high reinforcing effect as expected differently from the reinforcement member 22. Why the front end of the reinforcement member 22 is joined to the mount holding member 17 is just that the mount holding member 17 is located on the front end side of the reinforcement member 22. Specifically, the mount holding member 17 has only so a smaller plate thickness than that of the reinforcement member 22 as to have lower strength and rigidity than those of the reinforcement member 22. Hence, the structure, where the mount holding member 17 constitutes a part of a reinforcement member, has only a low reinforcement effect at a front part of the mount holding member 17, which makes the strength and rigidity of the entirety of the left side deck B be insufficient, resulting in the possibility of failure to meet the requirement on ROPS, which is the safety standard of a cabin in case of rollover of a construction machine.

SUMMARY OF THE INVENTION

An object of the invention is to provide an upper frame for a construction machine which has a side deck and allows the side deck to be effectively reinforced.

The invention provides an upper frame for a construction machine, the upper frame having a side deck on which a cabin is loaded. The side deck includes: a front beam extending laterally of the upper frame and having a left end and a right end; a rear beam extending laterally of the upper frame and having a left end and a right end, the rear beam positioned rearwardly of the front beam; a left vertical beam extending longitudinally of the upper frame to interconnect the left end of the front beam and the left end of the rear beam; a right vertical beam extending longitudinally of the upper frame to interconnect the right end of the front beam and the right end of the rear beam; left and right mount holding members attached to left corner portion formed by the front beam and the left vertical beam and right corner portion formed by the front beam and the right vertical beam, respectively, so as to be positioned on respective inner sides of the left and right corner portions, to hold respective cabin mounts; and a reinforcement member extending longitudinally of the side deck and having a front end and a rear end, the reinforce member being joined to an inner lateral surface of a beam to be reinforced which beam is selected from the left vertical beam and the right vertical beam. The mount holding member of the left and right mount holding members to be attached to the beam to be reinforced is a cross allowing member which has a shape avoiding the reinforcement member so as to allow the reinforcement member to extend across the cross allowing member longitudinally of the side deck. The front end of the reinforcement member is directly joined to the front beam while the reinforcement member extends longitudinally across the cross allowing member.

These and other objects, features and advantages of the present invention will become more apparent upon reading the following detailed description along with the accompanying drawings.

DESCRIPTION OF THE PREFERRED EMBODIMENTS

An embodiment of the invention is described referring to FIGS. 1 to 7C.

Figure 1:
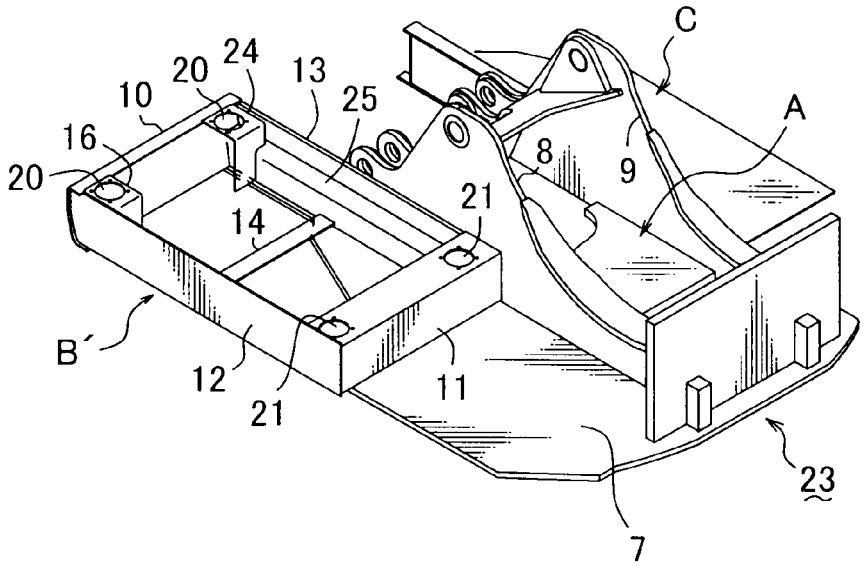
FIG. 1 is a perspective view of an upper frame according to a basic embodiment of the invention.

FIG. 1 shows the entirety of an upper frame 23 according to the embodiment of the invention. The basic construction of the upper frame 23 is substantially the same as that of the conventional upper frame 3 shown in FIGS. 9 through 13, and the elements of the upper frame 23 substantially identical or equivalent to those of the upper frame 3 are described with the same reference signs.

The upper frame 23 comprises a center section A positioned at a center of the upper frame 23 in the width direction of a hydraulic shovel, and left and right side decks B', C extending outwardly from left and right ends of the center section A. The working attachment 5 and the counterweight 6 are mounted to a front part and a rear end of the center section A, respectively. The cabin 4 is loaded on the left side deck B', and various devices such as an unillustrated tank are loaded on the right side deck C.

The center section A has a bottom plate 7 to which an unillustrated swing bearing is mounted, and a pair of left and right vertical plates 8, 9 formed on the bottom plate 7. The vertical plates 8, 9 vertically rise from left and right ends of the center section A while extending longitudinally.

Figure 2:
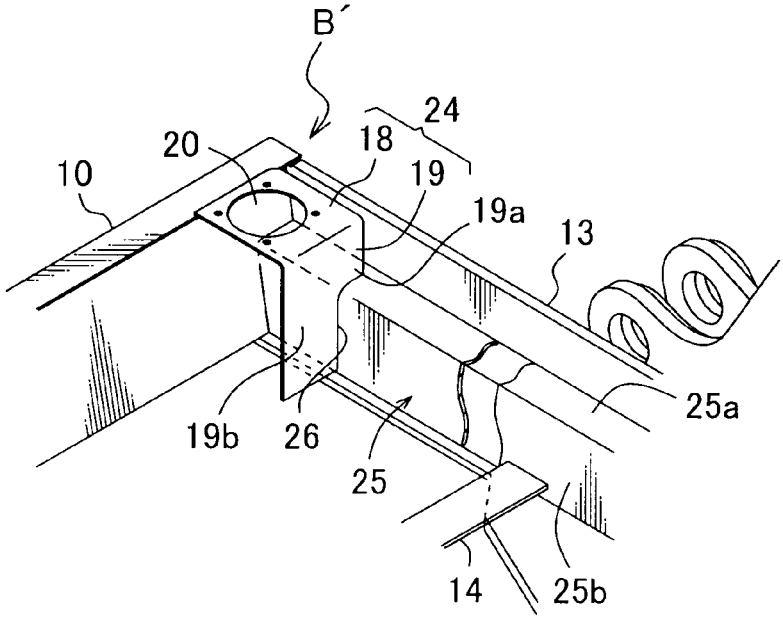
FIG. 2 is a perspective view enlargedly showing a front-right corner portion of a left side deck in the upper frame and a vicinity thereof, and is a partly cutaway diagram of a reinforcement member fixed to a right vertical beam.
Figure 3:
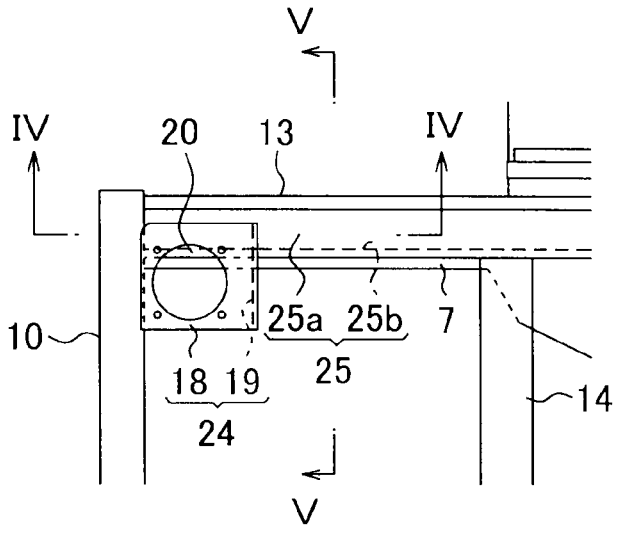
FIG. 3 is a plan view showing the front-right corner portion and the vicinity thereof.

The left side deck B' has a front beam 10, a rear beam 11, and left and right vertical beams 12, 13, which beams 10, 11, 12 and 13 constitute a frame-shaped body. Furthermore, a connecting member is optionally mounted to an intermediate portion of the body, while FIGS. 1 through 3 show only one transverse bar 14 as the connecting member.

Figure 5:
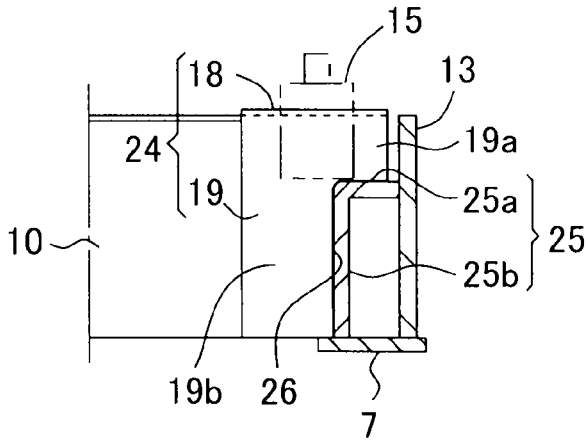
FIG. 5 is a sectional view taken along the line V-V in FIG. 3.
Figure 6:
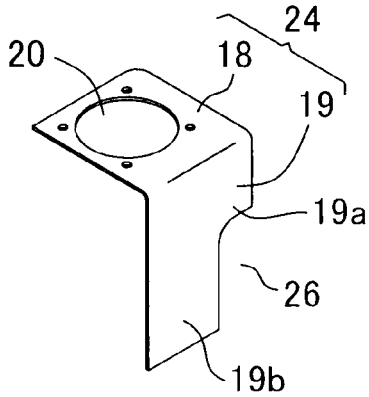
FIG. 6 is a perspective view of a mount holding member to be formed on the front-right corner portion.

The left side deck B' has a pair of left and right mount holding members 16 and 24. The mount holding members 16 and 24 are provided at respective left and right positions of a front end of the left side deck B' to hold respective front part cabin mounts 15 as shown in FIG. 5.

Each of the mount holding members 16, 24 integrally includes a horizontal upper plate portion 18 and a rear plate portion 19 extending perpendicularly downward from a rear end of the upper plate portion 18. The right mount holding member 24 is fixed to an inner lateral surface of a right corner portion formed by the front beam 10 and the right vertical beam 13 by welding, and the left mount holding member 16 is fixed to an inner lateral surface of a left corner portion formed by the front beam 10 and the left vertical beam 12 by welding. The upper plate portion 18 of each of the mount holding members 16, 24 has a mount insertion hole 20 into which the front part cabin mount 15 can be inserted and holds the front part cabin mount 15 inserted into the mount insertion hole 20.

Figure 9:
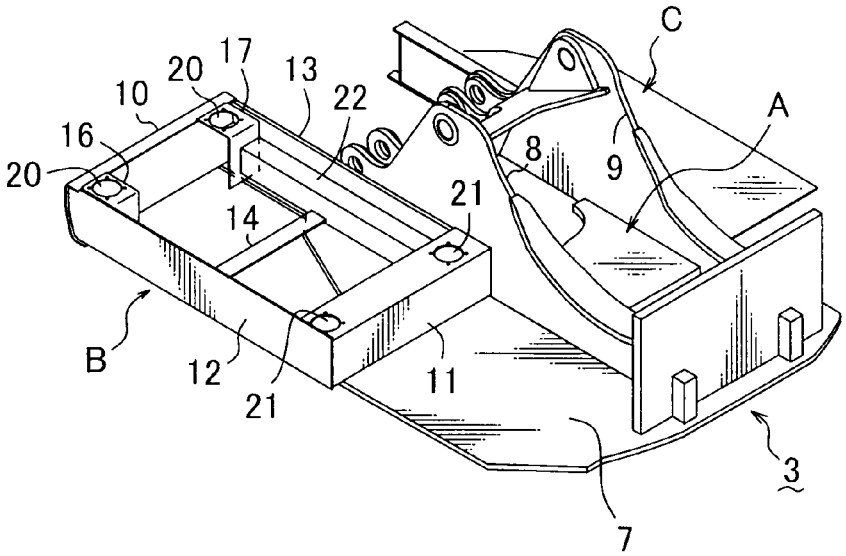
PRIOR ART FIG.9
FIG. 9 is a perspective view showing a conventional upper frame.
Figure 10:
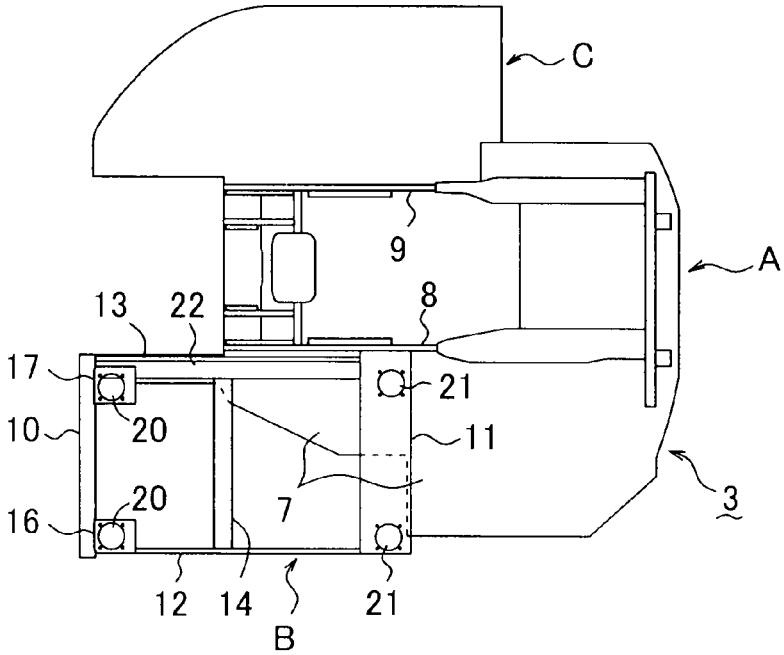
PRIOR ART FIG.10
FIG. 10 is a plan view of the upper frame shown in FIG. 9.
Figure 11:
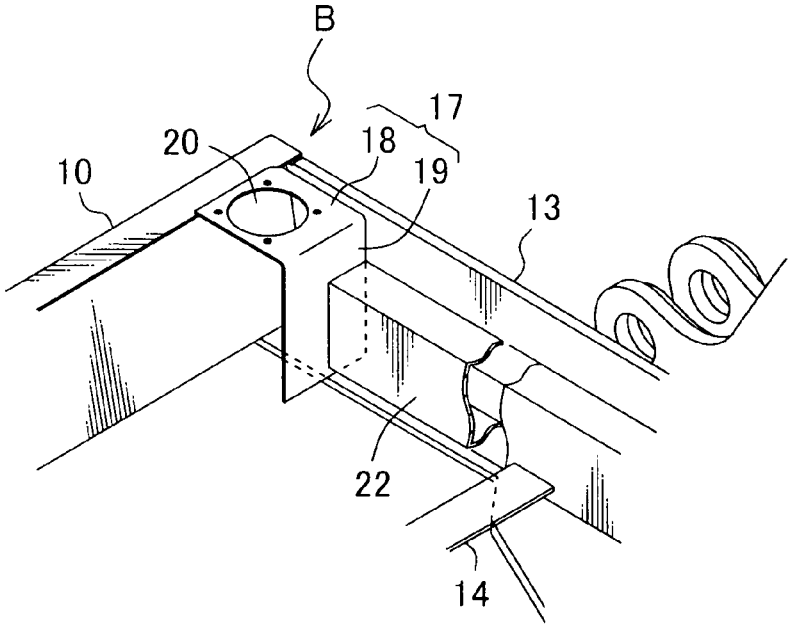
PRIOR ART FIG.11
FIG. 11 is a perspective view enlargedly showing a front-right corner portion of a left side deck in the conventional upper frame and a vicinity thereof, and is a partly cutaway diagram of a reinforcement member fixed to a right vertical beam.
Figure 12:
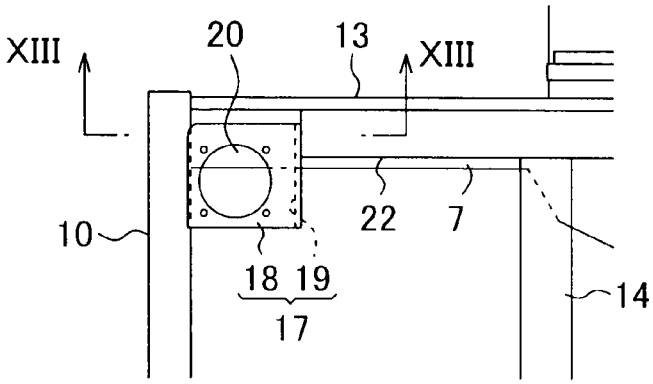
PRIOR ART FIG.12
FIG. 12 is a plan view showing the front-right corner portion and the vicinity thereof.
Figure 13:
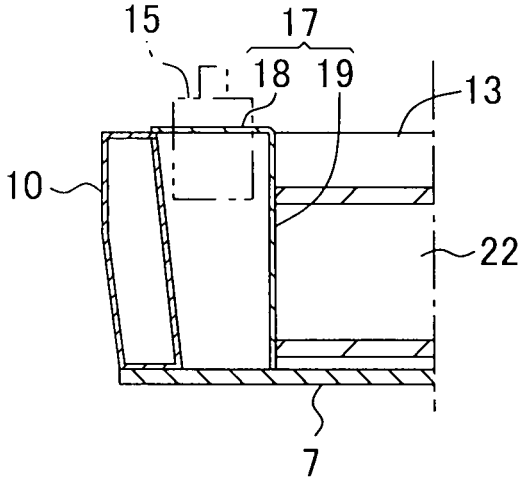
PRIOR ART FIG.13
FIG. 13 is a sectional view taken along the line XIII-XIII in FIG. 12.

The left and right side portions of the rear beam 11 are provided with similar mount attachment holes 21, 21 as shown in FIGS. 9, 10, respectively, into which not shown rear cabin mounts are inserted, respectively, to be attached to the rear beam 11.

Figure 4:
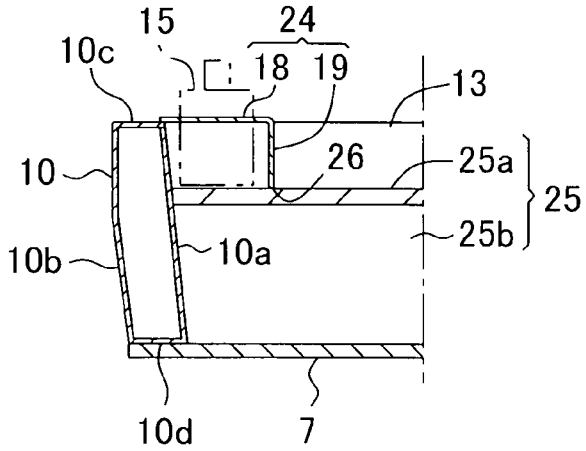
FIG. 4 is a sectional view taken along the line IV-IV in FIG. 3.

In this embodiment, in order to reinforce the left side deck B', the right vertical beam 13 is selected as a beam to be reinforced and a reinforcement member 25 is attached to an inner lateral surface of the right vertical beam 13. The reinforcement member 25 extends longitudinally and has a front end and a rear end, having a cross section as shown in FIG. 2, that is, a cross section of an inverse L-shape integrally including a horizontal upper plate portion 25*a* and a left plate portion 25*b* extending downwardly from an inner end (an end opposite to the right vertical beam 13) of the upper plate portion 25*a*. As shown in FIG. 4 and others, a lateral end i.e. a right end of the upper plate portion 25*a* is joined to the right vertical beam 13, and a lower end of the left plate portion 25*b* is joined to the bottom plate 7, over the entire length thereof, and the rear end of the reinforcement member 25 is joined to a front surface of the rear beam The side deck B' has a feature as follows. The mount holding member 24, which is one of the mount holding members 16, 24 and to be mounted on the right vertical beam 13 as the beam to be reinforced, has a shape which avoids the reinforcement member 25 so as to allow the reinforcement member 25 to extend across the mount holding member 12 longitudinally of the side deck B'. Specifically, the rear plate portion 19 of the right mount holding member 24 is formed with a cutaway part 26 at a right lower half portion thereof, the cutaway part 26 allowing the reinforcement member 25 to extend longitudinally through the cutaway part 26. In other words, the rear plate portion 19 has a first portion 19*a* positioned above the cutaway part 26 and a second portion 19*b* positioned lateral to the cutaway part 26 and on the side opposite to the right vertical beam 13. The first portion 19*a* is contacted with a top surface of the upper plate portion 25*a* of the reinforcement member 25, and a lower end of the first portion 19*a* and a lateral end of the second portion 19*b* on the side of the reinforcement member 25 are joined to the upper plate portion 25*a* and the left plate portion 25*b* of the reinforcement member 25, respectively.

Thus, the front end of the reinforcement member 25 can be directly joined to the right end of the front beam 10 while the reinforcement member 25 is allowed to extend longitudinally through the cutaway part 26 of the mount holding member 24.

The front beam 10 is formed as a so-called D-tube, which is a tubular body having closed upper and lower portions and closed front and rear portions. Specifically, the front beam 10 has, as shown in FIG. 4, an upper wall 10*c* and a lower wall 10*d* arranged on upper and lower sides respectively, and a front wall 10*b* and a rear wall 10*b* arranged on front and rear sides respectively, the walls 10*c*, 10*d*, 10*b* and 10*a* surrounding an interior space of the front beam 10. The front end of the reinforcement member 25 is joined to the rear wall 10*a*.

The reinforcement member 25 is disposed at such a height position as to avoid interference with the cabin mount 15 as shown in FIGS. 4, 5. Specifically, the reinforcement member 25 is disposed at such a height position as to extend beneath the cabin mount 15 held by the upper plate portion 18 of the mount holding member 24, and the front end of the reinforcement member 25 is joined to the rear wall 10*a* of the front beam 10 at a position lower than the cabin mount 15.

As described above, the front end of the reinforcement member 25 is not joined to the mount holding member 24 having lower strength and rigidity than those of the reinforcement member 25, differently from the conventional art, but joined to the front beam 10 having higher strength and rigidity than those of the mount holding member 24, which significantly enhances the reinforcing effect of the left side deck B' by the reinforcement member 25.

In the embodiment of the invention, the interference between the mount holding member 24 and the reinforcement member 25 can be avoided also by: offsetting the mount holding member 24 from the right vertical beam 13; decreasing the vertical dimension of the mount holding member 24; or forming the front end of the reinforcement member 25 into a shape bending so as to detour to the left around the mount holding member 24. Also these cases result in that the mount holding member 24 has a shape which avoids the reinforcement member 25 so as to allow the reinforcement member 25 to extend across the mount holding member 24 longitudinally of the side deck B'. However, forming the cutaway part 26 that allows the reinforcement member 25 to extend longitudinally across the mount holding member 24 as described in the embodiment enables the front end of the reinforcement member 25 to be directly joined to the front beam 10 while the reinforcement member 25 extends longitudinally across the mount holding member 24 without a drawback such as degradation of stability in the support of a cabin and the reinforcing effect by the reinforcement member 25, or complication in mounting the reinforcement member 25.

Furthermore, in the embodiment, since the front beam 10 is shaped into a tubular having closed upper and lower portions and closed front and rear portions and the front end of the reinforcement member 25 is joined to the rear wall 10*d* of the front beam 10, the front end of the reinforcement member 25 can be easily joined to the front beam, as compared with the case where the front beam 10 has a cross section of C-shape or the like opened rearward by omitting the rear wall 10*a*. Besides, the reinforcing effect of the left side deck B' by the reinforcement member 25 is further enhanced because of the high strength and rigidity of the front beam 10 itself.

The invention is not limited to the foregoing embodiment, but includes, for example, the following modifications.

Figure 7A:
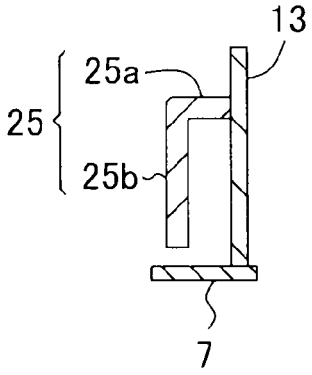
FIGS. 7A, 7B, 7C are sectional views each showing a modification of a cross-sectional shape of the reinforcement member.
Figure 7B:
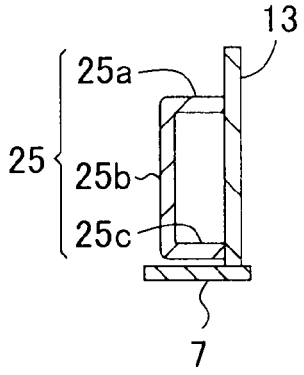
Figure 7C:
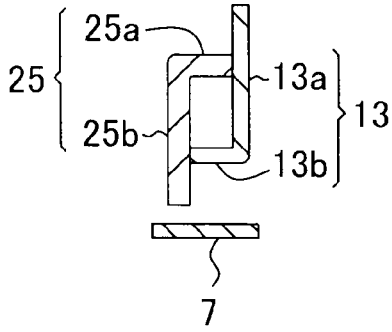
Figure 8:
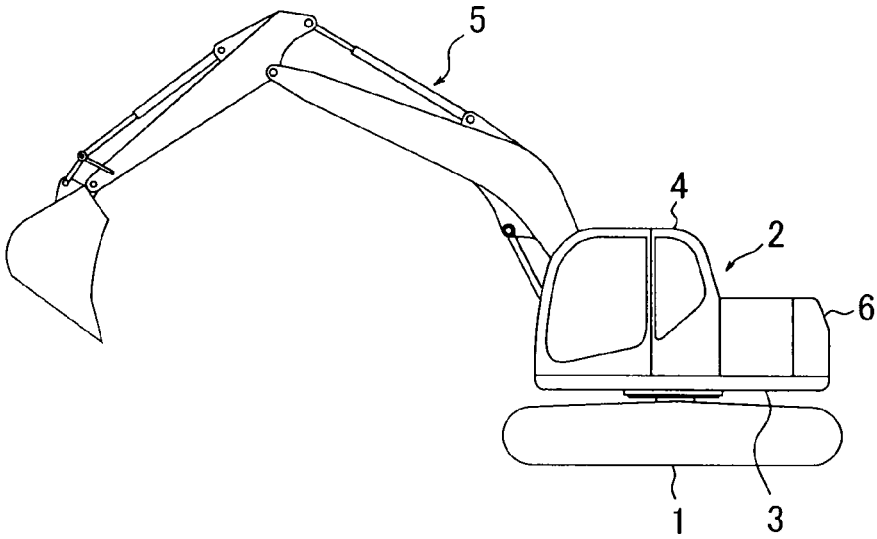
PRIOR ART FIG.8
FIG. 8 is a schematic side view of a hydraulic shovel to which the invention is applicable.

(1) Although, in the embodiment, the upper plate portion 25*a* and the left plate portion 25*b* of the reinforcement member 25 are joined to the right vertical beam 13 and the bottom plate 7 respectively, it is possible to join only the upper plate portion 25*a* of a reinforcement member 25 to a right vertical beam 13 while not joining the reinforcement member 25 to a bottom plate 7 as shown in FIG. 7A. Alternatively, as shown in FIG. 7B, there may be a reinforcement member 25 having a cross-sectional shape that integrally includes an upper plate portion 25*a*, a left plate portion 25*b* and a lower plate portion 25*c*, that is, a cross-sectional shape opened laterally, the upper and lower plate portions 25*a*, 25*c* being joined to a right vertical beam 13. Further alternatively, as shown in FIG. 7C, there may be a right vertical beam 13 having such a cross section of an L-shape that includes a vertical plate portion 13*a* extending vertically and a lower plate portion 13*b* projecting outwardly and horizontally direction from a lower end of the vertical plate portion 13*a*, while the reinforcement member 25 has a cross section of inverse L-shape including an upper plate portion 25*a* and a left plate portion 25*b* and is joined to the right vertical beam 13. Specifically, a lateral end of the upper plate portion 25*a* can be joined to a lateral surface of the vertical plate portion 13*a*, and a lateral end of the lower plate portion 13*b* can be joined to a lateral surface of the left plate portion 25*b*. In this case, the left plate portion 25*b* of the reinforcement member 25 may not be joined to the bottom plate 7, as shown in FIG. 7C, or may be joined to the bottom plate 7.

(2) The reinforcement member 25 may be attached to an inner lateral surface of the left vertical beam 12, or may be attached to an inner lateral surface of each of the left and right vertical beams 12, 13. In other words, the beam to be reinforced in the invention may be one of the left and right vertical beams 12, 13, or may be both of the left and right vertical beams 12, 13.

(3) The invention can be applied to the case where a rear portion of the beam to be reinforced is cut and another beam member is joined to the beam to be reinforced via a vertical joint plate; or to the case where a connecting beam is bridged between respective intermediate portions of the left and right vertical beams.

(4) The invention is not limited to a hydraulic shovel, but may be widely applied to a working machine comprising an upper frame with a side deck on which a cabin is loaded.

As described above, the invention provides an upper frame for a construction machine which has a side deck and allows the side deck to be effectively reinforced. The upper frame comprises a side deck on which a cabin is loaded, and the side deck includes: a front beam extending laterally of the upper frame and having a left end and a right end; a rear beam extending laterally of the upper frame and having a left end and a right end, the rear beam positioned rearward of the front beam; a left vertical beam extending longitudinally of the upper frame to interconnect the left end of the front beam and the left end of the rear beam; a right vertical beam extending longitudinally of the upper frame to interconnect the right end of the front beam and the right end of the rear beam; left and right mount holding members attached to a left corner portion formed by the front beam and the left vertical beam and a right corner portion formed by the front beam and the right vertical beam, respectively, so as to be positioned on respective inner sides of the left and right corner portions, to hold respective cabin mounts; and a reinforcement member extending longitudinally of the side deck and having a front end and a rear end, the reinforce member being joined to an inner lateral surface of a beam to be reinforced which is selected from the left vertical beam and the right vertical beam. The mount holding member of the left and right mount holding members to be attached to the beam to be reinforced is a cross allowing member having a shape which avoids the reinforcement member so as to allow the reinforcement member to extend across the cross allowing member longitudinally of the side deck. The front end of the reinforcement member is directly joined to the front beam while the reinforcement member extends longitudinally across the cross allowing member.

In this upper frame, since the front end of the reinforcement member is not joined to the mount holding member having lower strength and rigidity than those of the reinforcement member, differently from the conventional art, but is joined to the front beam having higher strength and rigidity than those of a mount holding member, the reinforcing effect of the side deck by the reinforcement member is remarkably enhanced.

Specifically, it is preferable that the cross allowing member has such a shape that a part thereof on the side of an inner lateral surface of the beam to be reinforced is cut away to allow the reinforcement member to extend longitudinally across the cross allowing member and the front end of the reinforcement member is joined to the front beam while the reinforcement member extends longitudinally between the cutaway part and the beam to be reinforced. The cross allowing member having such a cutaway part eliminates a necessity of offsetting the cross allowing member, reducing the size of the cross allowing member, or bending a front end of the reinforcement member to detour around the cross allowing member, in order to avoid interference between the cross allowing member and the reinforcement member. This enables the front end of the reinforcement member to be directly joined to the front beam without a drawback such as degradation of stability in the support of a cabin and the reinforcing effect by the reinforcement member, or complicating an operation for mounting the reinforcement member.

Specifically, the cross allowing member may preferably include: a mount holding portion to hold the cabin mount, the mount holding portion extending longitudinally of the side deck and having a front end to be joined to the front beam and a rear end opposite to the front end; and a rear plate portion extending downwardly from the rear end of the mount holding member, the cutaway part being formed in the rear plate portion. The cross allowing member enables holding the cabin mount and allowing the reinforcement member to extend across the cross allowing member to be realized simultaneously, while keeping the rigidity of the cross allowing member itself.

In this case, the rear plate portion of the cross allowing member is preferable if including a first portion positioned above the cutaway part and a second portion positioned at a lateral side of the cutaway part and on the side opposite to the beam to be reinforced, the first portion making contact with a top surface of the reinforcement member. The contact allows the reinforcement member to support the cross allowing member and the cabin mount to be held thereon from lower side.

Furthermore, if the first portion and the second portion are joined to the reinforcement member extending through the cutaway part, the rigidity of the cross allowing member is further enhanced.

Besides, it is preferable that the reinforcement member is disposed at such a height position as to extend beneath the cabin mount held by the mount holding member and the front end of the reinforcement member is joined to the front beam at a position lower than the cabin mount. This structure permits the front end of the reinforcement member to be directly joined to the front beam while avoiding interference between the cabin mount and the reinforcement member, without greatly offsetting the cabin mount from the beam to be reinforced.

On the other hand, it is preferable that the front beam has an upper wall and a lower wall arranged at upper and lower sides respectively and a front wall and a rear wall arranged at front and rear sides respectively; the upper wall, the lower wall, the front wall and the rear wall are shaped into a tubular surrounding an interior space of the front beam, the front end of the reinforcement member being joined to the rear wall. This allows the front end of the reinforcement member to be easily joined to the front beam and the front end of the reinforcement member, and enhances the reinforcing effect of the left side deck by the reinforcement member because of the high strength and rigidity of the front beam itself, as compared with the case, for example, where the front beam has a cross section opened rearward and the front end of the reinforcement member is joined to the front wall of the front beam.

This application is based on Japanese Patent Application No. 2010-251854 filed on Nov. 10, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An upper frame for a construction machine, comprising a side deck on which a cabin is loaded, the side deck including:

a front beam extending laterally of the upper frame and having a left end and a right end;

a rear beam extending laterally of the upper frame and having a left end and a right end, the rear beam being positioned rearward of the front beam;

a left vertical beam extending longitudinally of the upper frame to interconnect the left end of the front beam and the left end of the rear beam;

a right vertical beam extending longitudinally of the upper frame to interconnect the right end of the front beam and the right end of the rear beam;

left and right mount holding members attached to a left corner portion formed by the front beam and the left vertical beam and a right corner portion formed by the front beam and the right vertical beam, respectively, so as to be positioned on respective inner sides of the left and right corner portions, to hold respective cabin mounts, one of the left and right mount holding members being a reinforcement-side mount holding member attached to a corner portion by the side of a reinforced beam selected from the left vertical beam and the right vertical beam; and a reinforcement member extending longitudinally of the side deck, having a front end and a rear end, and being joined to an inner lateral surface of the reinforced beam, the reinforcement member and the reinforcement-side mount holding member overlapping each other in a vertical direction, wherein the reinforcement-side mount holding member is a cross allowing member which has a shape avoiding the reinforcement member so as to allow the reinforcement member to extend across the reinforcement-side mount holding member longitudinally of the side deck, and the front end of the reinforcement member is directly joined to the front beam while the reinforcement member extends longitudinally across the cross allowing member.

2. An upper frame for a construction machine, comprising a side deck on which a cabin is loaded, the side deck including:

a front beam extending laterally of the upper frame and having a left end and a right end;

a rear beam extending laterally of the upper frame and having a left end and a right end, the rear beam being positioned rearward of the front beam;

a left vertical beam extending longitudinally of the upper frame to interconnect the left end of the front beam and the left end of the rear beam;

a right vertical beam extending longitudinally of the upper frame to interconnect the right end of the front beam and the right end of the rear beam;

left and right mount holding members attached to a left corner portion formed by the front beam and the left vertical beam and a right corner portion formed by the front beam and the right vertical beam, respectively, so as to be positioned on respective inner sides of the left and right corner portions, to hold respective cabin mounts; and a reinforcement member extending longitudinally of the side deck and having a front end and a rear end to be joined to an inner lateral surface of a beam to be reinforced which beam is selected from the left vertical beam and the right vertical beam, wherein the mount holding member of the left and right mount holding members to be attached to the beam to be reinforced is a cross allowing member which has a shape avoiding the reinforcement member so as to allow the reinforcement member to extend across the mount holding member longitudinally of the side deck, and the front end of the reinforcement member is directly joined to the front beam while the reinforcement member extends longitudinally across the cross allowing member, wherein the cross allowing member has such a shape that a part thereof on the side of an inner lateral surface of the beam to be reinforced is cut away to allow the reinforcement member to extend longitudinally across the cross allowing member, and the front end of the reinforcement member is joined to the front beam while the reinforcement member extends longitudinally between the cutaway part and the beam to be reinforced.

3. The upper frame for a construction machine according to claim 2, wherein the cross allowing member includes: a mount holding portion to hold the cabin mount, the mount holding portion extending longitudinally and having a front end of the side deck to be joined to the front beam and a rear end opposite to the front end; and a rear plate portion extending downwardly from the rear end of the mount holding member, the cutaway part being formed in the rear plate portion.

4. The upper frame for a construction machine according to claim 3, wherein the rear plate portion of the cross allowing member has a first portion positioned above the cutaway part and a second portion positioned on the lateral side of the cutaway part and on the side opposite to the beam to be reinforced, the first portion making contact with a top surface of the reinforcement member.

5. The upper frame for a construction machine according to claim 4, wherein the first portion and the second portion are joined to the reinforcement member extending through the cutaway part.

6. The upper frame for a construction machine according to claim 3, wherein the reinforcement member is disposed at such a height position as to extend beneath the cabin mount held by the mount holding member, and the front end of the reinforcement member is joined to the front beam at a position lower than the cabin mount.

7. The upper frame for a construction machine according to claim 1, wherein the front beam has an upper wall and a lower wall arranged at upper and lower sides respectively and a front wall and a rear wall arranged at front and rear sides, the upper wall, the lower wall, the front wall and the rear wall are shaped into a tubular surrounding an interior space of the front beam, and the front end of the reinforcement member is joined to the rear wall.

8. The upper frame for a construction machine according to claim 1, wherein the reinforcement member is bent in section.

* * * * *